US005865655A

United States Patent [19]

Hiraoka et al.

[11] Patent Number: 5,865,655

[45] Date of Patent: Feb. 2, 1999

[54] ACCESSORY DRIVE FOR OUTBOARD MOTOR

[75] Inventors: Noriyoshi Hiraoka; Masanori Takahashi; Atsushi Isogawa, all of Hamamatsu, Japan

[73] Assignee: Sanshin Kogyo Kabushiki Kaisha, Hamamatsu, Japan

[21] Appl. No.: 876,768

[22] Filed: Jun. 16, 1997

[30] Foreign Application Priority Data

Jun. 14, 1996 [JP] Japan ..... 8-154111
Jun. 19, 1996 [JP] Japan ..... 8-157764

[51] Int. Cl.[6] ..... B63H 21/32

[52] U.S. Cl. ..... 440/89; 440/900; 440/77; 123/90.31; 123/195.4 HC

[58] Field of Search ..... 440/77, 88, 89, 440/900; 123/90.31, 195 P, 195 HC

[56] References Cited

U.S. PATENT DOCUMENTS 5,184,582 2/1993 Okui et al. .
5,309,877 5/1994 Shigedomi et al. ..... 440/900
5,388,555 2/1995 Shiomi et al. ..... 440/900
5,554,060 9/1996 Koishikawa et al. ..... 440/88

*Primary Examiner*—Stephen Avila
*Attorney, Agent, or Firm*—Knobbe, Martens, Olson & Bear LLP

[57] ABSTRACT

A drive arrangement for an engine positioned within a cowling of an outboard motor and powering a water propulsion device of the motor is disclosed. Preferably, the engine is of the "V"-type, having first and second banks and an intake and exhaust camshaft corresponding to each bank. A drive arrangement is provided for driving the camshafts off of a crankshaft of the engine. Preferably, a flexible transmitter is positioned at a bottom end of the engine and directly drives one camshaft of each bank from the crankshaft, with the other camshaft of each bank driven by the driven camshaft.

20 Claims, 17 Drawing Sheets

ACCESSORY DRIVE FOR OUTBOARD MOTOR

FIELD OF THE INVENTION

The present invention relates to an engine of the type utilized to power an outboard motor. More particularly, the invention is a drive arrangement for camshafts and other accessories of an engine positioned within a cowling of an outboard motor and powering a water propulsion device of the motor.

BACKGROUND OF THE INVENTION

Outboard motors which are used to propel watercraft are positioned at the stern of the watercraft, generally attached to the transom. These motors comprise a cowling which houses an internal combustion engine. The engine is arranged to drive a water propulsion device of the motor, such as a propeller.

The motor is connected to the watercraft in a manner which permits the motor to turn from side-to-side about a vertically extending axis for use in steering the watercraft. In addition, the motor is tiltable about a generally horizontal axis for use in trimming the motor.

Because the motor is movably mounted to the craft, it is desirable for the motor to be as small as practical. It is, therefore, an object of the present invention to provide an engine which is compact in arrangement.

In addition, if the motor extends far beyond the rear of the watercraft, its center of gravity is far offset from the horizontal axis about which it tilts, making it very difficult to tilt the motor. Also, moving the center of gravity of the motor far from the stem of the watercraft affects the dynamics of the watercraft.

It is therefore another object of the present invention to provide an engine having a center of gravity positioned such that when the engine is used to power a motor connected to a watercraft, is close to the watercraft.

SUMMARY OF THE INVENTION

In accordance with the present invention, there is provided an outboard motor having a water propulsion device which is powered by an internal combustion engine. The engine has a drive arrangement for driving at least one camshaft.

Preferably, the engine is positioned within a cowling of an outboard motor and is arranged so that a crankshaft thereof is generally vertically extending. The engine has at least one combustion chamber and a member movably mounted in the combustion chamber for driving the crankshaft. An intake passage leads into the chamber and an exhaust passage leads from the chamber. Valve means are provided for selectively closing at least a portion of the intake and exhaust passages. Preferably, at least one camshaft actuates said first and second valve means.

A drive arrangement is provided for driving each camshaft from the crankshaft. In a first embodiment, a flexible transmitter is positioned at a bottom end of the engine and directly drives at least one camshaft.

Preferably, the engine is of the "V" type, having a first bank defining at least one combustion chamber and a second bank defining at least one combustion chamber, with at least one camshaft is provided corresponding to each bank. In this arrangement, the flexible transmitter is arranged to directly drive one of the camshafts of each bank. In a preferred embodiment, an intake and exhaust camshaft is provided corresponding to each bank. In a first arrangement, the flexible transmitter is arranged to drive the intake camshaft of one bank and the exhaust camshaft in the other bank. In a second arrangement, the flexible transmitter is arranged to drive the exhaust camshaft of both banks. In either arrangement, timing drive means are provided for driving the camshaft of each bank which is not directly driven by the camshaft which is.

In another embodiment, the flexible transmitter is positioned at the top end of the engine below a flywheel connected to the top end of the crankshaft. A pulley is preferably positioned above the flywheel, and a flexible transmitter extends in driving engagement with the pulley and an engine accessory, such as an alternator.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

In accordance with the present invention, there is provided an outboard motor 20 powered by an engine 22 and having an engine component or accessory drive arrangement in accordance with the present invention. The engine 22 having the drive arrangement system is described for use with an outboard motor 20 since this particular application is one requiring the compact arrangement of the engine 22 described. It should be understood, however, that the engine 22 may be used in other applications.

Figure 1:
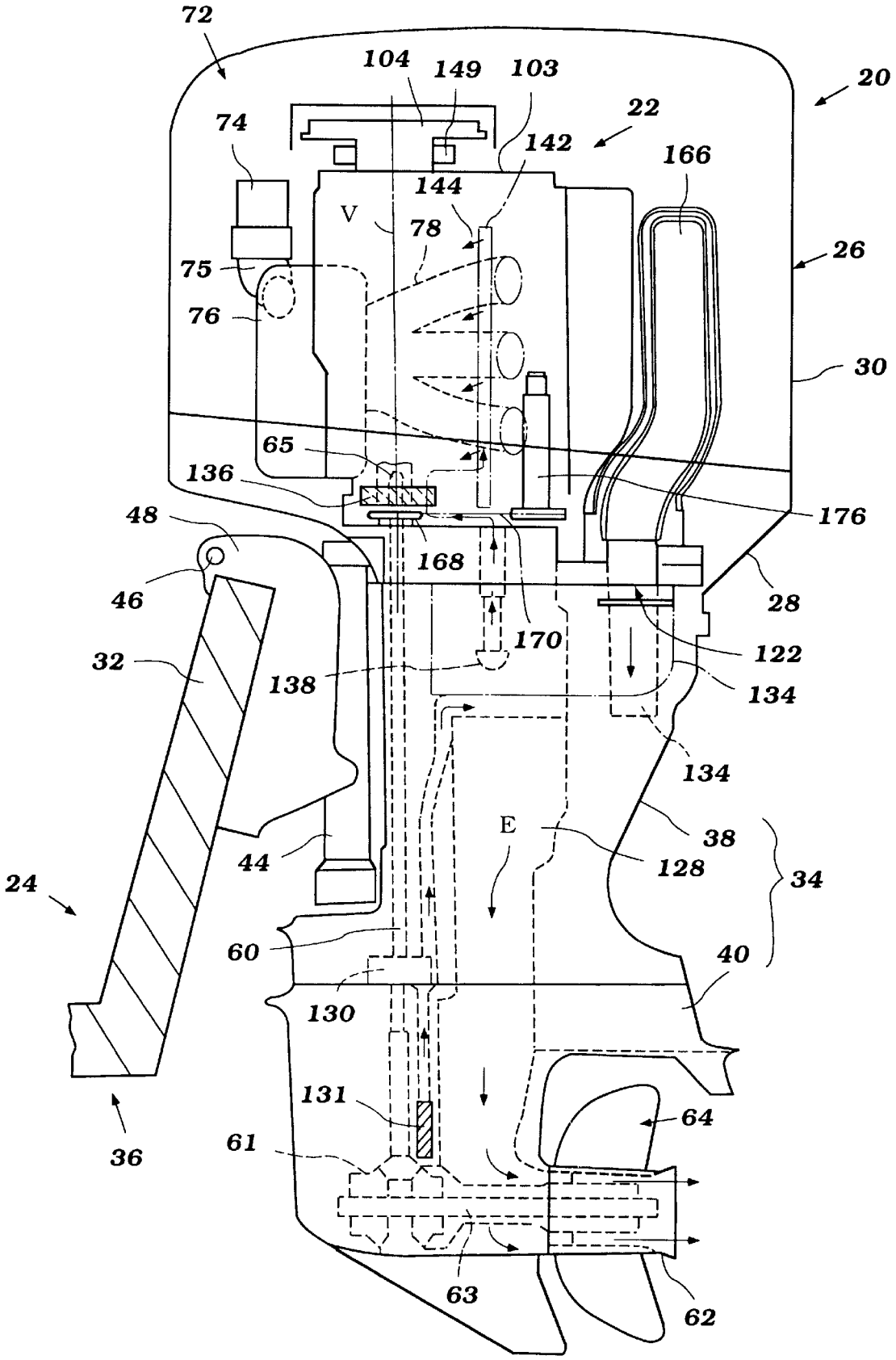
FIG. 1 is a side view of an outboard motor powered by an engine, illustrated in phantom, the motor having a drive arrangement in accordance with a first embodiment of the present invention.

As illustrated in FIG. 1, the outboard motor 20 is of the type utilized to propel a watercraft 24. The outboard motor 20 has a powerhead area 26 comprised of a lower tray portion 28 and a main cowling portion 30. The motor 20 includes a lower unit 34 extending downwardly from the cowling portion 30. The lower unit 34 comprises an upper or "drive shaft housing" section 38 and a lower section 40.

The powerhead area 26 of the motor 20 is connected to a steering shaft (not shown). The steering shaft is supported for steering movement about a vertically extending axis within a swivel or steering bracket 44. The swivel bracket 44 is connected by means of a pivot pin 46 to a clamping bracket 48 which is attached to a transom portion 32 of a hull 36 of the watercraft 24. The pivot pin 46 permits the outboard motor 20 to be trimmed and tilted up about the horizontally disposed axis formed by the pivot pin 46.

Figure 2:
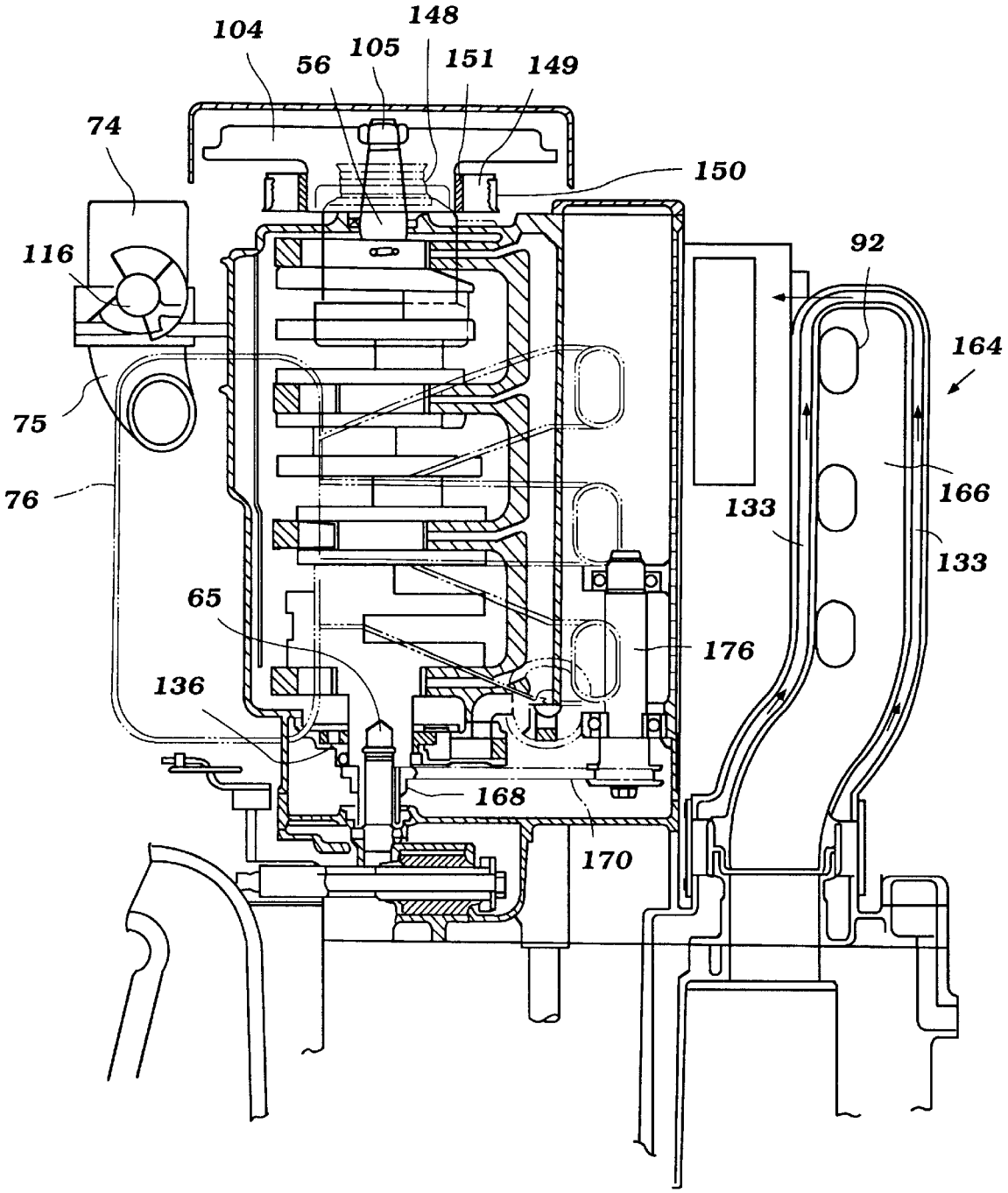
FIG. 2 is a cross-sectional side view of a portion of the engine of the motor illustrated in FIG. 1.
Figure 5:
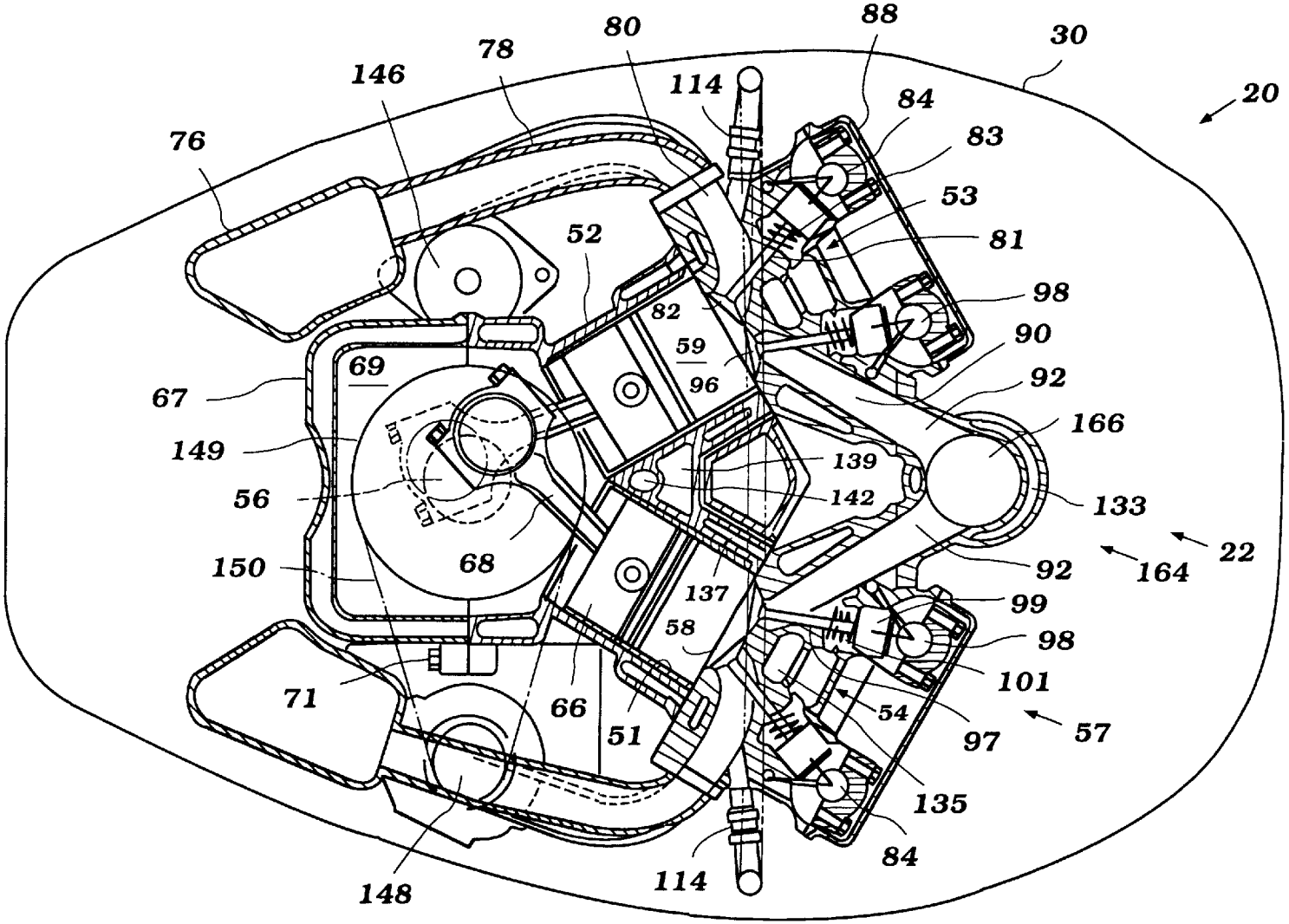
FIG. 5 is a cross-sectional top view of the motor illustrated in FIG. 1, taken along a plane passing through the engine therein.
Figure 6:
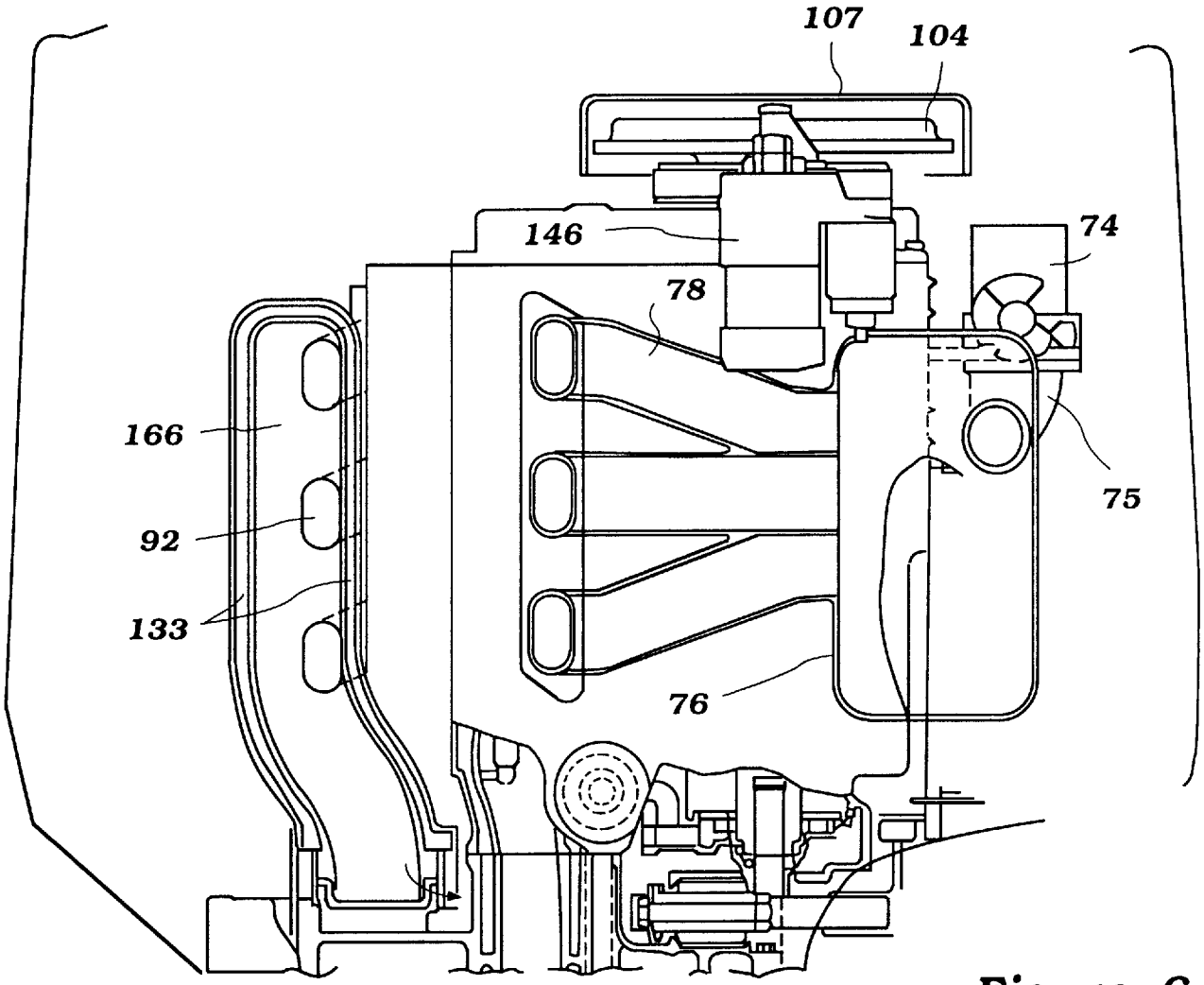
FIG. 6 is a rear view of the engine of the motor illustrated in FIG. 1, illustrating an exhaust arrangement thereof.

Referring to FIGS. 1, 2 and 5, the power head 26 of the outboard motor 20 includes the engine 22 which is positioned within the cowling portion 30. The engine 22 is preferably of the six-cylinder, four-cycle variety, and is arranged in a "V" fashion. In this arrangement, the engine 22 has a cylinder block 52 with a first cylinder head 53 and a second cylinder head 54 connected thereto and cooperating therewith to define first and second cylinder banks 55,57 defining a valley therebetween. This valley faces away from the watercraft to which the motor 20 is attached. Each bank preferably defines three cylinders 59, each having a combustion chamber 58. As may be appreciated by those skilled in the art, the engine 22 may have a greater or lesser number of cylinders, such as two, four, or eight or more.

As illustrated in FIG. 5, a piston 66 is movably positioned in each cylinder 59, each cylinder lined with a cylinder sleeve 51. Each piston 66 is connected to a connecting rod 68 extending to a vertically extending (i.e. along a vertical axis "V" as illustrated in FIG. 1) crankshaft 56. Referring to FIG. 2, the crankshaft 56 is connected to a top end 65 of a drive shaft 60 which extends downwardly through the lower unit 34, where it drives a bevel gear and a conventional forward-neutral-reverse transmission 61. A control (not shown) is preferably provided for allowing an operator to remotely control the transmission from the watercraft 24.

The transmission drives a propeller shaft 63 which is journalled within the lower section 40 of the lower unit 34 in a known manner. A hub 62 of a propeller 64 is coupled to the propeller shaft 63 for providing a propulsive force to the watercraft 24 in a manner well known in this art.

The crankshaft 56 is journalled for rotation with respect to the cylinder block 52. A crankcase cover 67 engages an end of the block 52 generically opposite the heads 53, 54, defining therewith a crankcase chamber 69 within which the crankshaft rotates. The crankcase cover 67 may be attached to the cylinder block 52 by bolts 71 or similar means for attaching known to those skilled in the art. The crankcase chamber 69 is positioned generally opposite the heads 53,54 and on the side of the engine closest to the watercraft 24.

The engine 22 includes an air intake system 72 for providing air to each combustion chamber 58. The intake system 72 is preferably positioned at the crankcase or watercraft end of the engine 22. As illustrated in FIGS. 1 and 2, air passes through a vent (not shown) in the motor cowling 30 and into a main intake pipe 74. As best illustrated in FIG. 2, a throttle 116 is provided for controlling the flow of air into the combustion chambers 58. Preferably, the throttle 116 comprises a moveable plate positioned within air intake pipe 74, such that the intake pipe 74 may be generally referred to as a throttle body. The throttle 116 is preferably controlled through a cable by the operator of the watercraft.

Branch pipes or passages 75 lead from the main intake pipe or throttle body 74 to first and second surge tanks 76 having branches 78 extending therefrom. The branch pipes 75 may be formed separately or integrally with the throttle body 74. Preferably, each surge tank 76 has three branches 78 extending therefrom, one for each cylinder 59 in a bank. Each branch 78 extends to a passage 80 in the cylinder head 53,54 leading to one of the combustion chambers 58.

Figure 8:
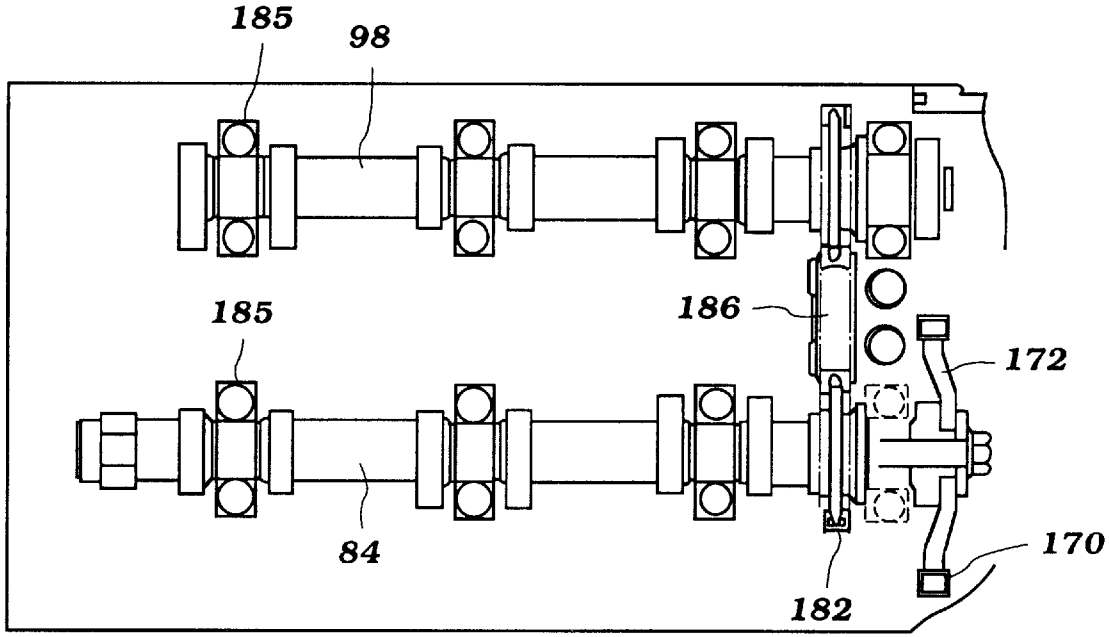
FIG. 8 is a partial side view of the engine illustrated in FIG. 1, illustrating the camshaft drive arrangement thereof.

Referring still to FIG. 5, means are provided for controlling the flow of air into each combustion chamber 58. Preferably, this means comprises at least one intake valve 82 corresponding to each intake passage 80. As illustrated, all of the intake valves 82 for each bank of cylinders are preferably actuated by a single intake camshaft 84. The intake camshaft 84 is mounted for rotation with respect to its respective cylinder head 53, 54 and connected thereto with at least one bracket. Each intake camshafts 84 rotates within an enclosure defined by the cylinder head 54, 55 and a camshaft cover 88, and is rotatably connected to its respective head 54, 55 via one or more bearings or journals 185 (See FIG. 8). The drive arrangement by which the camshafts 84 are rotated is described in detail below.

Each valve 82 has a head which is adapted for seating against a valve seat in the passage 80, and a stem extending from the head through a valve guide 81 to a follower 83. A spring 85 is positioned between the follower 83 and a portion of the cylinder head 53, 54 for biasing the valve 82 upwardly into a closed position.

An exhaust system is provided for routing the products of combustion within the combustion chambers 58 to a point external to the engine 22. In particular, an exhaust passage 90 leads from each combustion chamber to a passage 92. The remainder of the exhaust system is described in more detail below.

Referring still to FIG. 5, means are also provided for controlling the flow of exhaust from each combustion chamber 58 to its respective exhaust passage 90. Preferably, this means comprises at least one exhaust valve 96. Like the intake valves 82, the exhaust valves 96 of each cylinder bank are preferably all actuated by a single exhaust camshaft 98. Each exhaust camshaft 98 is journalled for rotation with respect to its respective cylinder head 54, 55 and connected thereto with at least one bracket. Each exhaust camshaft 98 is enclosed within the camshaft cover 88. The drive arrangement by which the camshafts 98 are rotated is described in detail below.

As with the intake valve 82, each exhaust valve 96 preferably includes a head for selective positioning against a valve seat in the passage 90. A stem extends from the head of the valve 96 through a valve guide 97 in the cylinder head 53,54. A follower 99 is positioned at the opposite end of the stem for engagement by the camshaft 98. A spring 101 is positioned between the follower 99 and the cylinder head 53,54 for biasing the valve 96 into its closed position.

The flywheel 104 is preferably maintained in position on the top end of the crankshaft 56 with a nut 105. The flywheel 104 is preferably positioned under a flywheel cover 107.

As best illustrated in FIG. 1, an exhaust guide 122 is positioned at the bottom end of the engine 22. The exhaust guide 122 has a passage 124 extending therethrough which communicates with the exhaust passages 92 in a manner described in more detail below. An exhaust pipe 126 is connected to the bottom side of the exhaust guide 122 in alignment with the passage 124. The exhaust pipe 126 terminates within a chamber of a muffler 128.

Figure 3:
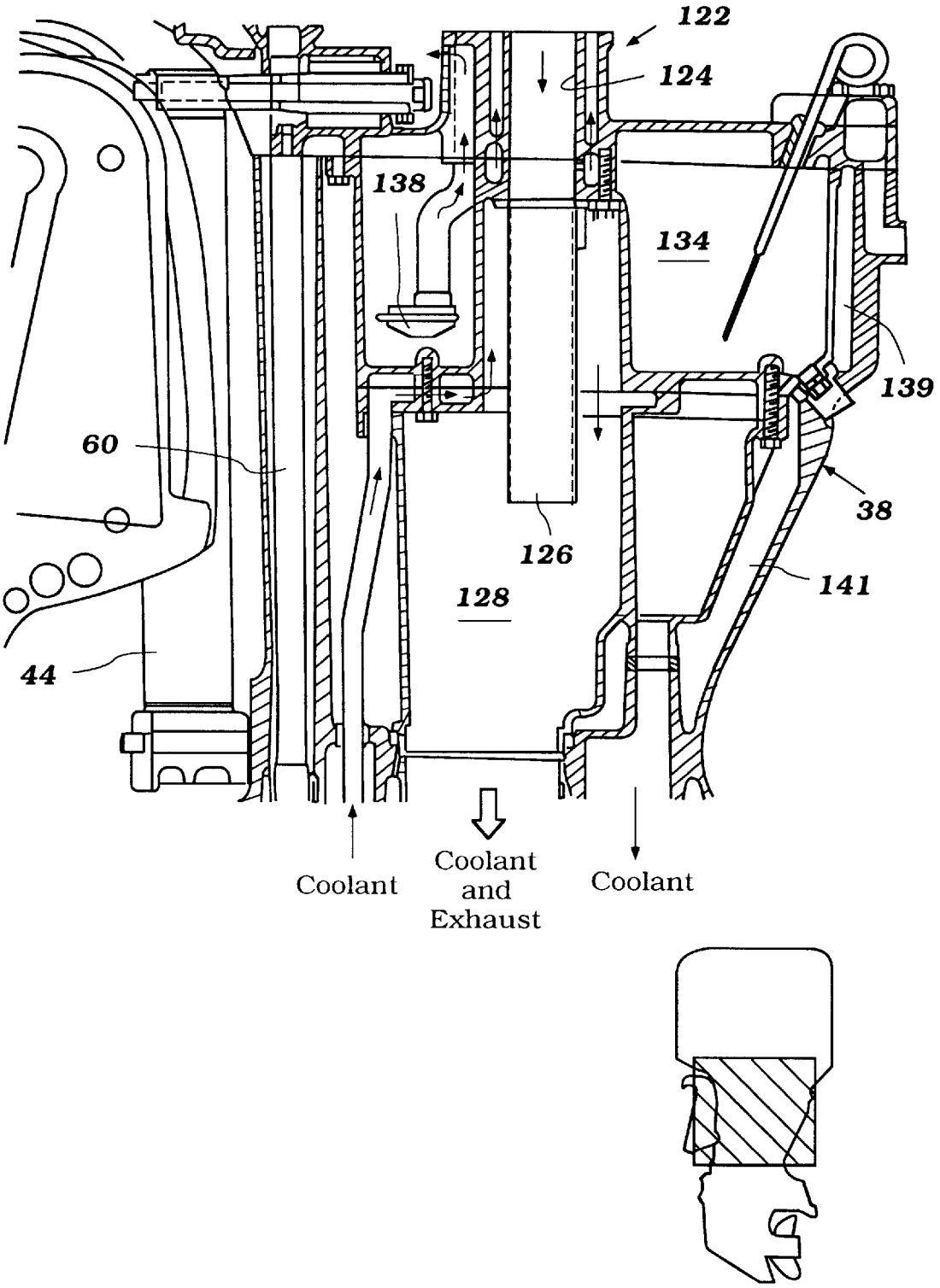
FIG. 3 is an enlarged cross-sectional side view of a middle portion of the motor illustrated in FIG. 1.
Figure 4:
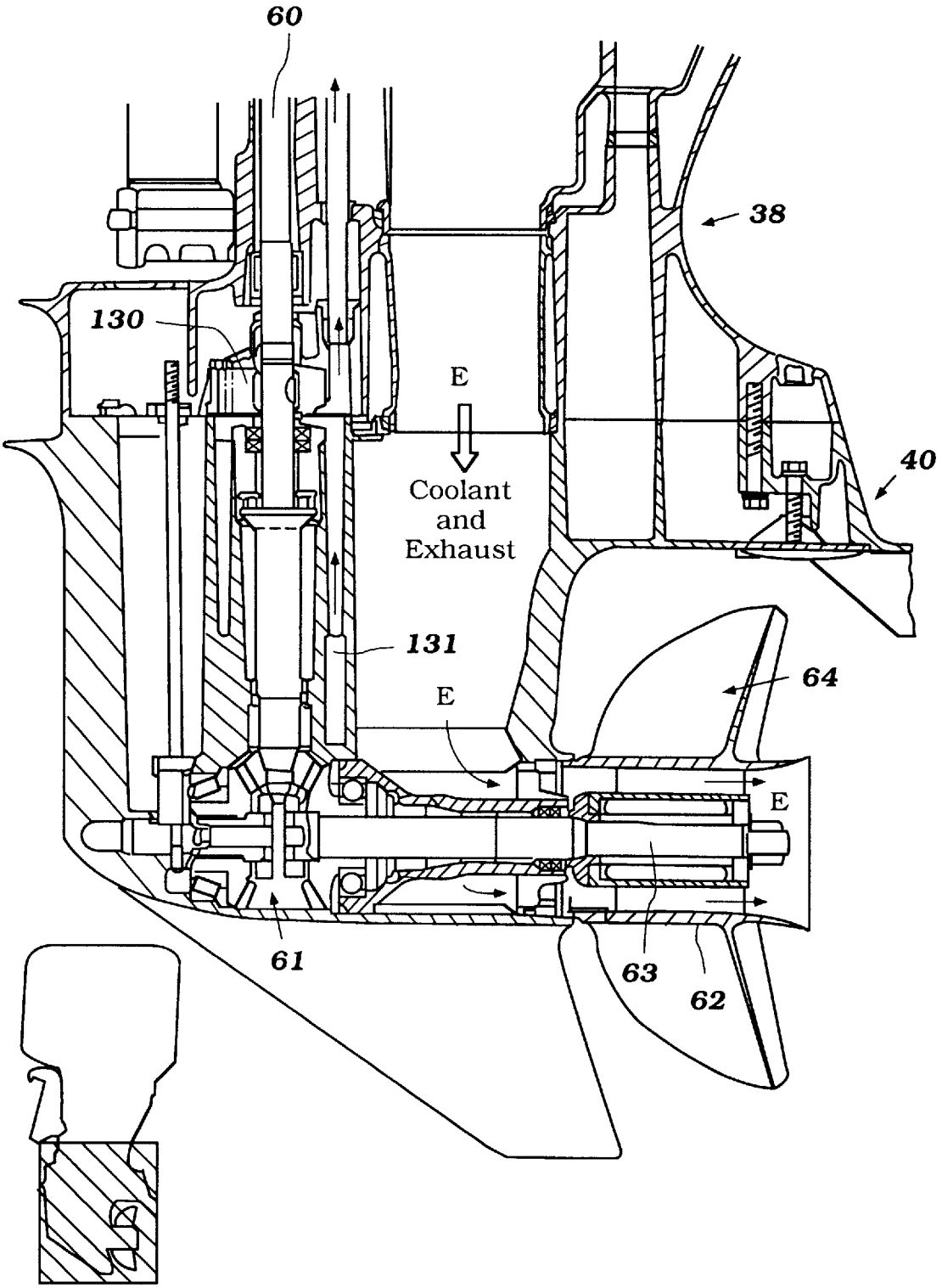
FIG. 4 is an enlarged cross-sectional side view of a lower portion of the motor illustrated in FIG. 1.

Referring also to FIG. 3, the muffler 128 is positioned within the lower unit 34 and between the drive shaft 60 and a cooling liquid return. An exhaust gas outlet is provided in the bottom end of the muffler 128, through which the exhaust gas is routed (in the direction of arrows "E") through the hub 62 of the propeller 64 to a point external of the motor 20, as best illustrated in FIG. 4.

A fuel delivery system is provided for delivering fuel to each combustion chamber 58 for combustion therein. As the fuel system does not form a portion of the present invention, it is not described in detail. A suitable fuel delivery system as well known in the art may be employed. Such a delivery system may include a low pressure pump which pumps fuel from a supply through a filter to a vapor separator. The fuel may then be delivered by a high pressure pump under pressure into a high pressure fuel line, and thereon to fuel rails having passages leading to fuel injectors 114. Preferably, an individual fuel injector 114 is provided corresponding to each cylinder 59.

A suitable ignition system is provided for igniting an air and fuel mixture within each combustion chamber 58. Such systems are well known to those skilled in the art, and as the ignition system forms no part of the present invention, such is not described in detail herein. The ignition system may include a spark plug for use in igniting the air and fuel mixture within each combustion chamber 58.

A cooling system is provided for cooling the engine 22. Referring to FIG. 1, cooling liquid, preferably water from the body of water in which the motor 22 is positioned, is pumped by a water pump 130 positioned in the lower unit 34 through a water inlet 131. The pump 130 is preferably driven by the drive shaft 60, and expels the cooling liquid upwardly through a cooling liquid pipe 132. The coolant flows through the supply pipe 132 from the pump 130 to the coolant jacket 133 for cooling the areas of the engine 22 surrounding the exhaust passage 92. The cooling liquid then passes into a number of cooling liquid passages 135 throughout the cylinder heads 53,54 and then to coolant jackets 137 around the cylinders 59 in the cylinder block 52.

A pressure valve (not shown) may be utilized to divert coolant through a relief passage and thereon to the coolant drain system in the event the coolant pressure exceeds a predetermined high pressure.

In addition, a thermostat (not shown) may be positioned along the coolant path for monitoring the temperature of the coolant. The thermostat may be provided so that if the coolant temperature is high, a valve corresponding to the thermostat is opened and coolant is allowed to flow though the engine 22 at a high rate, but if the temperature of the coolant is low, then the valve is closed, allowing the engine to warm up.

After being routed through the cylinder block 52 and heads 53, 54, the cooling liquid is preferably routed to a generally vertically extending return passage 139 through the cylinder block 52 (illustrated schematically in FIG. 1), for draining the cooling liquid to the bottom of the engine 22. The coolant is then split. Referring to FIG. 3, a first amount of coolant is directed to a coolant pool 139 surrounding an oil reservoir or pan 134, and another pool 141 near the muffler 128. When the liquid level in the pool 141 becomes to high, the cooling liquid runs over an overflow ledge or weir to a passage leading to a drain. The cooling liquid diverted to the drain is discharged from the motor.

The remaining amount of coolant is directed around the exhaust pipe 126 for cooling it. This coolant then flows into the muffler 128, where it is mixed with the exhaust gas. The coolant is carried with the exhaust gas through the propeller hub 62 discharge back to the body of water.

Preferably, the engine 22 includes a lubricating system for providing lubricant to the various portions of the engine in accordance with the present invention. Referring to FIGS. 1–3, the lubricating system includes the oil reservoir 134 positioned below the engine 22. The reservoir 134 is in communication with an oil pump 136 via a suction tube 138. The oil pump is drivingly positioned on the end of the crankshaft 56 at the bottom of the engine 22. Seals are provided for sealing the oil pump with respect to the remainder of the engine 22. The oil pump draws lubricant from the reservoir 134 and then delivers it through a connecting passage to a main gallery 142. Branch passages 144 extend from the main gallery 142 for providing lubricant to crankshaft bearings and the like. The oil preferably flows, with the aid of gravity, back into the reservoir 134 from the engine 22.

As illustrated in FIG. 5, the engine 22 may include additional engine auxiliary features or accessories such as a starter motor 146 and an alternator 148. Preferably, the starter motor 146 is positioned for engagement with the flywheel 104 for use in starting the engine 22, as is well known to those skilled in the art.

The alternator 148 is preferably utilized to produce electricity for firing the spark plugs and similar functions. The alternator 148 is run by a belt 150 which is driven by a pulley 149 mounted on the end of the crankshaft 56 just below the flywheel 104. In the embodiment illustrated, the pulley 149 is actually connected to a downwardly extending flange portion of the flywheel 104, but vibration isolated from the flywheel 104 with a rubber mount 151 (See FIG. 2).

The motor 20 includes an exhaust system. As disclosed above, exhaust is routed through a passage 90 from each cylinder 59 in a cylinder head 53, 54 to a main exhaust passage 92. As best illustrated in FIG. 5, each exhaust passage 90 extending through the cylinder head 53, 54 from each combustion chamber 58 extends generally diagonally towards away from the watercraft and towards the valley between the cylinder banks 55, 57.

An exhaust manifold 164 is connected to the engine 22. The manifold 164 has branch passages 92 which extend from a main passage 166. A branch passage 92 extends from the main passage 166 to meet a corresponding one of the exhaust passages 90. The main exhaust passage 92 extends along the length of the engine 22 to the passage 124 (See FIG. 3) in the exhaust guide 122 and thereafter through the remainder of the exhaust system.

In this arrangement, the main gallery 142 of the lubricating system preferably extends vertically through the portion of the cylinder block 52 positioned between the cylinder banks 55, 57 and between the coolant return passage 139.

So arranged, the coolant jacket 133 surrounding the exhaust passage 92 is positioned on each side thereof, part of the jacket 133 formed within the cylinder block 52 and part within each cylinder head 53, 54. The cylinder cooling jackets 137 are positioned within the walls of the cylinder block 52 adjacent the jacket 133, but defined separately therefrom.

Figure 7:
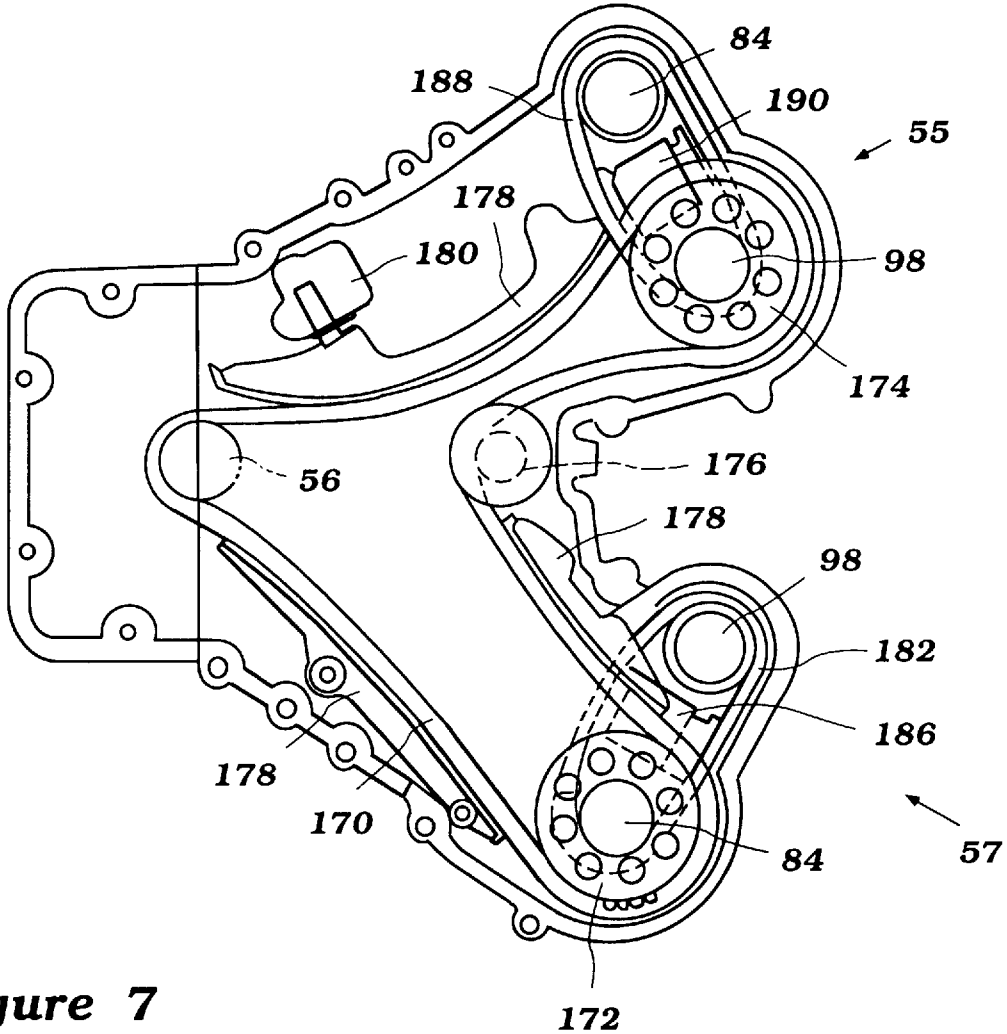
FIG. 7 is a cross-sectional view of the engine illustrated in FIG. 1, illustrating a camshaft drive arrangement thereof.

In accordance with the present invention, a drive arrangement is not only provided for engine accessories such as the alternator 148, but for the camshafts 84, 98. As best illustrated in FIG. 7, means are provided for driving the camshafts 84,98 off of the crankshaft 54.

Preferably, means are provided for directly driving at least one camshaft of each bank 55,57 with the crankshaft 56. As illustrated, this means includes a toothed gear 168 (See FIG. 2) is mounted to a bottom portion of the crankshaft 56 near its connection to the top end 65 of the drive shaft 60 and at a bottom end of the engine 22. A flexible transmitter, in the form of main timing chain 170, extends from the toothed gear or sprocket 68 to a gear or sprocket 172 mounted on the intake camshaft 84 of one bank 57, then around an idler 176 positioned within the engine 22 but between its banks 55,57, around a gear or sprocket 174 positioned on the exhaust camshaft 98 of the other bank 55, and then back to the sprocket 168 mounted on the crankshaft 56.

Several chain guides 178 are preferably provided along the travel path of the chain 170 for maintaining it in position. In addition, at least one chain tensioner 180 is provided for maintaining the chain taunt. In the embodiment illustrated, the tensioner 180 is connected to one of the guides 178 for pressing the guide 178 against the chain 170.

Means also are provided for timingly driving the other camshaft of each bank 55, 57 which is not directly driven by the crankshaft 56. Preferably, a secondary chain 182 extends around the gear 172 mounted on the intake camshaft 84 of the first bank 57 to a gear positioned on the exhaust camshaft 98 of that bank. In this manner, rotation of the gear 172 on the intake camshaft 84 of this bank 57 effectuates synchronous rotation of the exhaust camshaft 98 of that bank as well. Again, a chain tensioner 186 is utilized to maintain the chain in taunt condition (See also FIG. 8).

Another secondary chain 188 extends around the gear 174 positioned on the exhaust camshaft 98 of the other bank 55 and to a gear positioned on the intake camshaft 84 of that bank 55. The chain 188 is preferably maintained in taunt condition with a suitable chain tensioner 190.

The sprockets or gears are preferably chosen so that the camshafts 84,98 are rotated at a desired timing speed.

Figure 9:
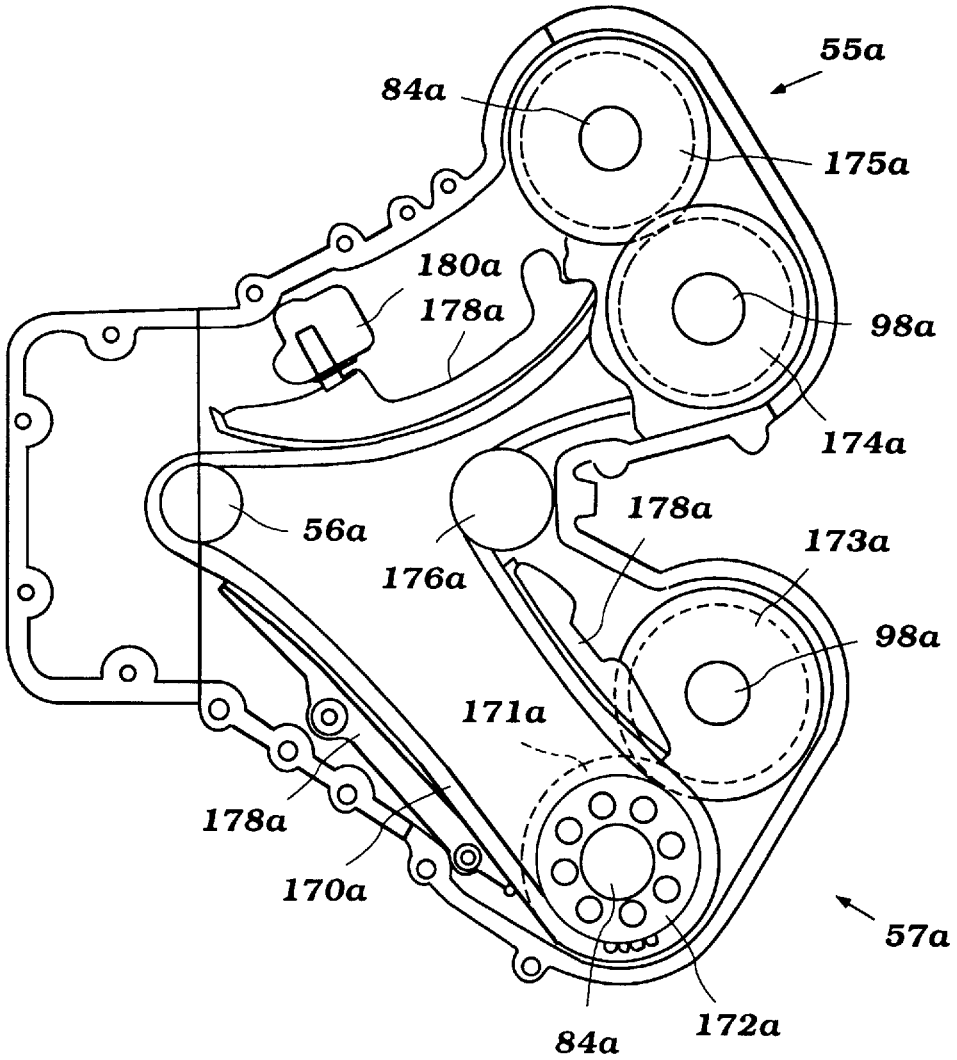
FIG. 9 is a cross-sectional side view of an engine having a camshaft drive arrangement in accordance with a second embodiment of the present invention.
Figure 10:
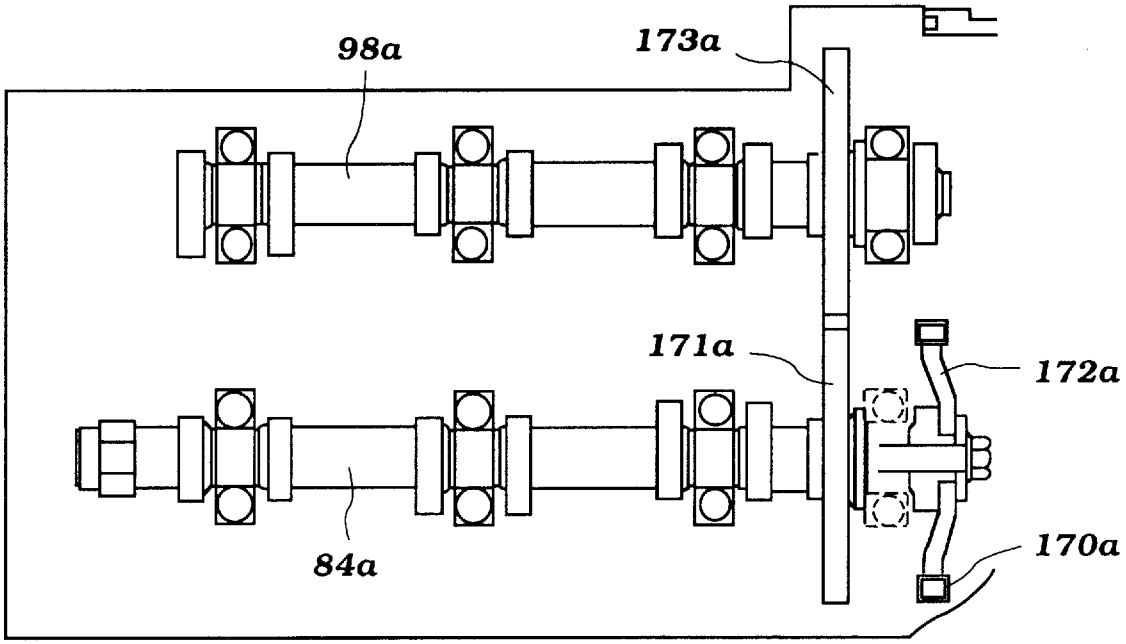
FIG. 10 is a partial side view of the engine having the camshaft drive arrangement in accordance with the second embodiment of the present invention.

FIGS. 9 and 10 illustrate a second drive arrangement in accordance with the present invention. In the description and illustrations of this embodiment, like reference numerals have been utilized to refer to like parts to those in the first embodiment, and an "a" designator has been added to all reference numerals of this embodiment.

In this embodiment, the primary timing chain 170*a* extends around the toothed gear 172*a* mounted on the intake camshaft 84*a* of one bank 57*a*. The timing chain 170*a* then extends around an idler 176*a*, and then a gear positioned on the exhaust camshaft 98*a* of the other bank 57*a*. In this manner, one camshaft of each bank 55,57 is directly driven by the crankshaft 56*a*.

Again, means are provided for driving the other camshaft of each bank 55, 57. A gear 171*a* positioned above the toothed gear 172*a* on the intake camshaft 84*a* of the first bank 57*a* is arranged to be in driving engagement with a similar gear 173*a* mounted on the exhaust camshaft 98*a* of that bank 57*a* (See FIG. 10). In this manner, rotation of the intake camshaft 84*a* of the bank 57*a* causes rotation of the exhaust camshaft 98*a* of that bank.

Likewise, a gear 174*a* mounted on the exhaust camshaft 98*a* of the other bank 55*a* is arranged in driving relation with a mating gear 175*a* positioned on the intake camshaft 84*a* of that bank 55*a*. So arranged, rotation of the exhaust camshaft 98*a* of that bank 55*a* causes synchronous rotation of the intake camshaft 84*a* of that bank.

Figure 11:
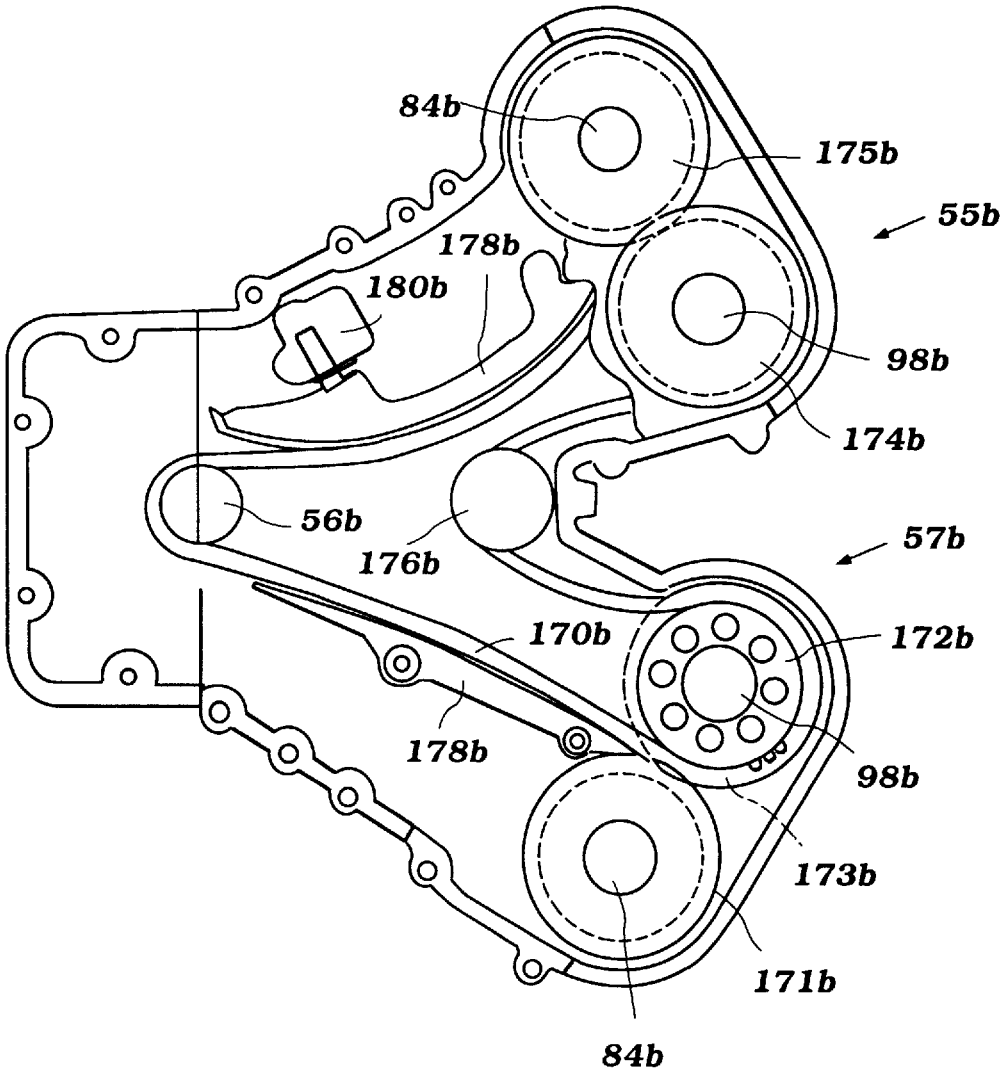
FIG. 11 is a cross-sectional view of an engine having a camshaft drive arrangement in accordance with a third embodiment of the present invention.

FIG. 11 illustrates a third embodiment drive arrangement in accordance with the present invention. In the description and illustration of this embodiment, like reference numerals have been utilized to refer to like parts to those in the embodiments above, and a "b" designator has been added to all reference numerals corresponding to this embodiment.

In this embodiment, the primary timing chain 170*b* extends from the toothed gear positioned on the crankshaft 56*b* to a toothed gear 172*b* positioned on the exhaust camshaft 98*b* of the first bank 57*b*, and then around the idler 176*b* and a gear on the exhaust camshaft 98*b* of the other bank 55*b*. Mating gears 171*b*, 173*b* and 174*b*, 175*b* are provided on the intake and exhaust camshafts 84*b*, 98*b* of each bank 55*b*, 57*b* for driving the intake camshafts 84*b* in a manner similar to that described above. Thus, in this embodiment, the primary difference in the drive arrangement is that both exhaust camshafts 98*b* are directly driven by the timing chain 170*b*, instead of one intake and one exhaust camshaft as in the previous embodiment illustrated in FIGS. 9 and 10.

FIGS. 12–17 illustrate a fourth drive arrangement in accordance with the present invention. In the description and illustrations of this embodiment, like reference numerals have been utilized to refer to like parts to those in the above embodiments, and a "c" designator has been added to all reference numerals.

In this embodiment, the fuel system is illustrated as including a low pressure fuel pump 115*c*, fuel filter 117*c* and vapor separator 118*c* as described (but not illustrated) in conjunction with the first embodiment. As illustrated, these fuel system elements are positioned at the crankcase end of the engine 22*c*.

The cooling system is arranged so that coolant flows first through the exhaust manifold cooling jacket 133*c*. A pressure relief valve 191*c* is preferably positioned along the coolant path after the coolant jacket 133*c*. This pressure relief valve l91*c* is utilized to divert coolant through a relief passage 192*c* and thereon to the coolant drain system in the event the coolant pressure exceeds a predetermined high pressure.

A thermostat 193*c* is positioned along the coolant path for monitoring the temperature oaf the coolant. A control valve is also positioned along the coolant path preferably before the coolant passes through the cylinder block and heads 52*c*, 53*c*, 54*c* of the engine 22*c*. The thermostat 193*c* is preferably positioned along the coolant path downstream of the passages 135*c*, 137*c* through the cylinder block and heads 52*c*, 53*c*, 54*c*. The control valve is controlled by the thermostat 193*c*, such that if the coolant temperature is high, the valve is opened to allow coolant to flow through the engine 22*c* at a high rate. On the other hand, if the temperature of the coolant is low, then the valve is closed, allowing the engine to warm up.

As in the previous embodiment, the coolant which is returned from the exhaust manifold cooling jacket 133*c* or from the engine 22*c* is split into paths A and B. A first amount of coolant is directed to a coolant pool 139*c* surrounding an oil reservoir or pan 134*c*, and another pool 141*c* near the muffler 128*c*. When the liquid level in the pool 141*c* becomes too high, the cooling liquid runs over an overflow ledge or weir to a passage leading to a drain. The cooling liquid diverted to the drain is discharged from the motor.

The remaining amount of coolant is directed around the exhaust pipe 126*c* for cooling it. This coolant then flows into the muffler 128*c,* where it is mixed with the exhaust gas. The coolant is carried with the exhaust gas through the propeller hub discharge back to the body of water.

Figure 12:
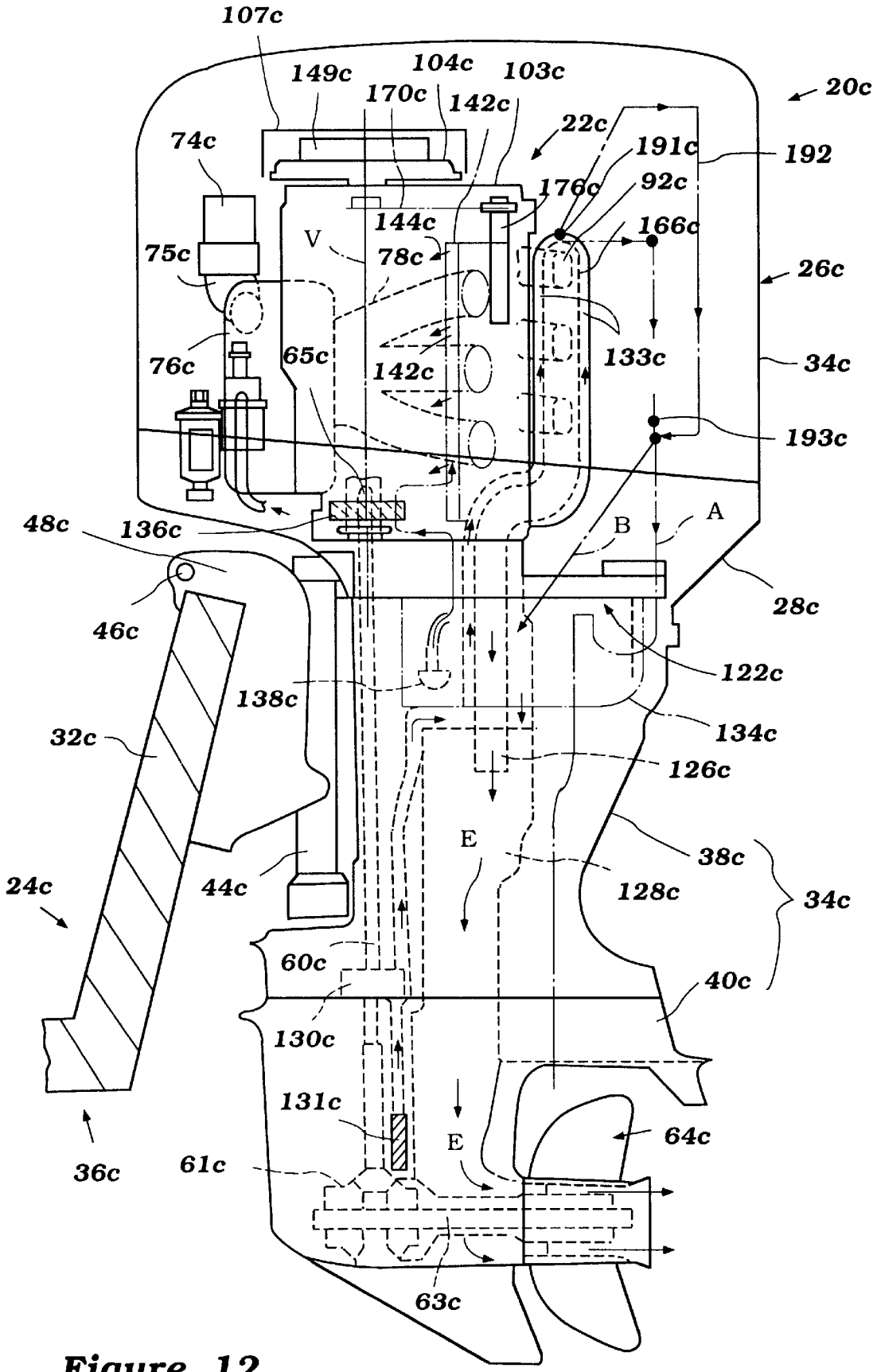
FIG. 12 is a side view of an outboard motor powered by an engine, illustrated in phantom, the motor having a drive arrangement in accordance with a fourth embodiment of the present invention.
Figure 13:
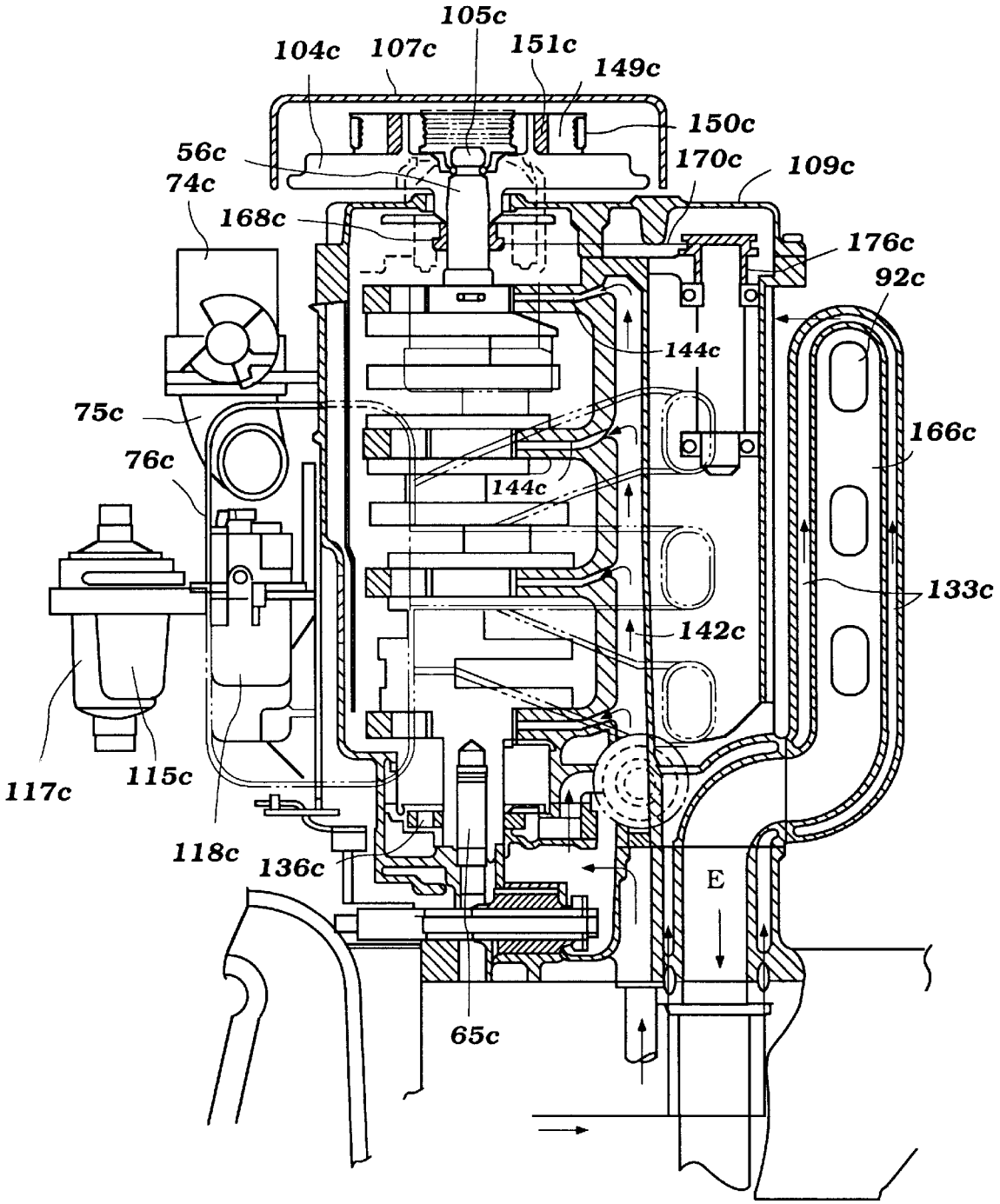
FIG. 13 is a cross-sectional side view of the engine illustrate in FIG. 12.
Figure 14:
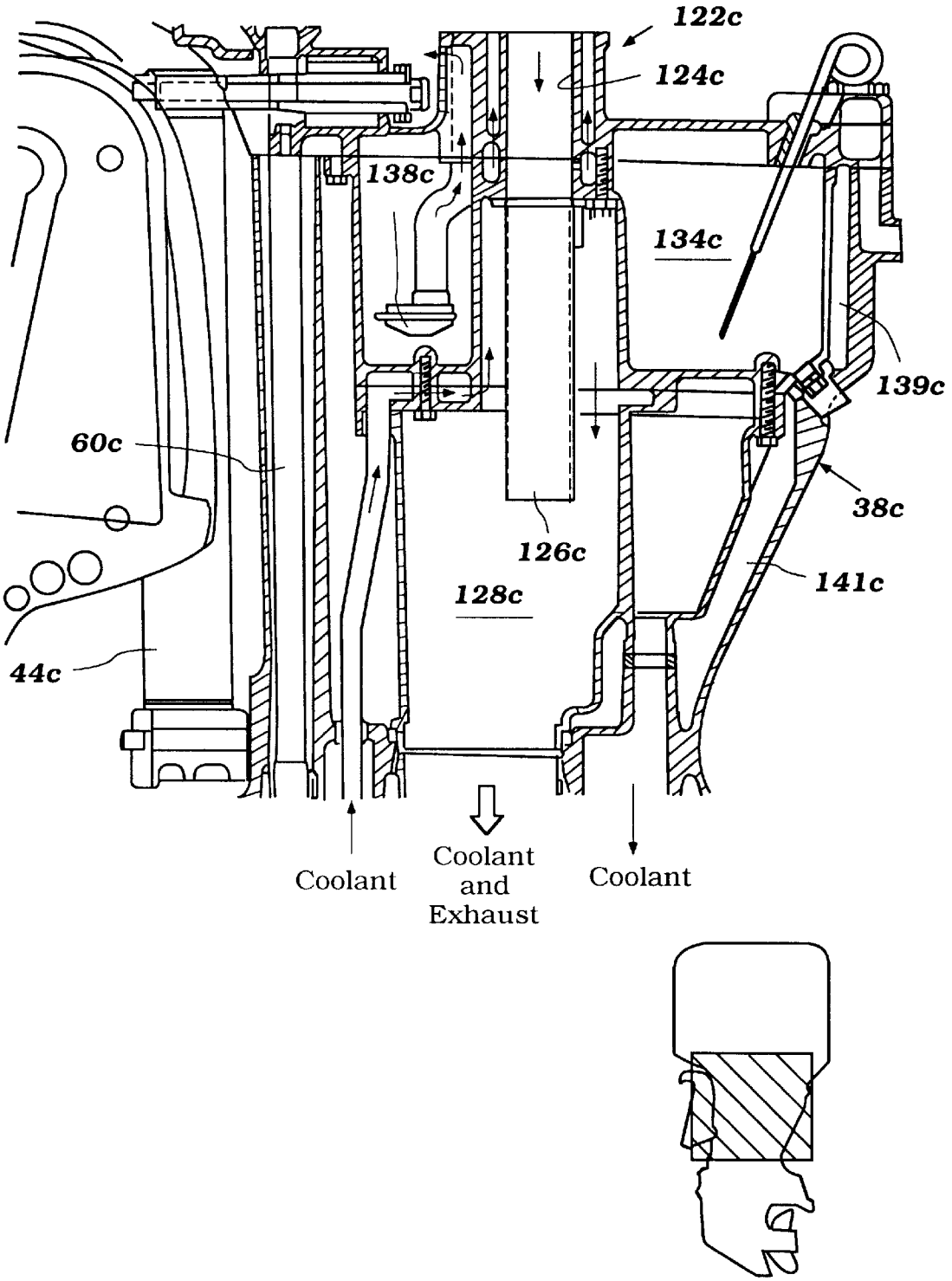
FIG. 14 is an enlarged cross-sectional view of a middle portion of the motor illustrated in FIG. 12.
Figure 15:
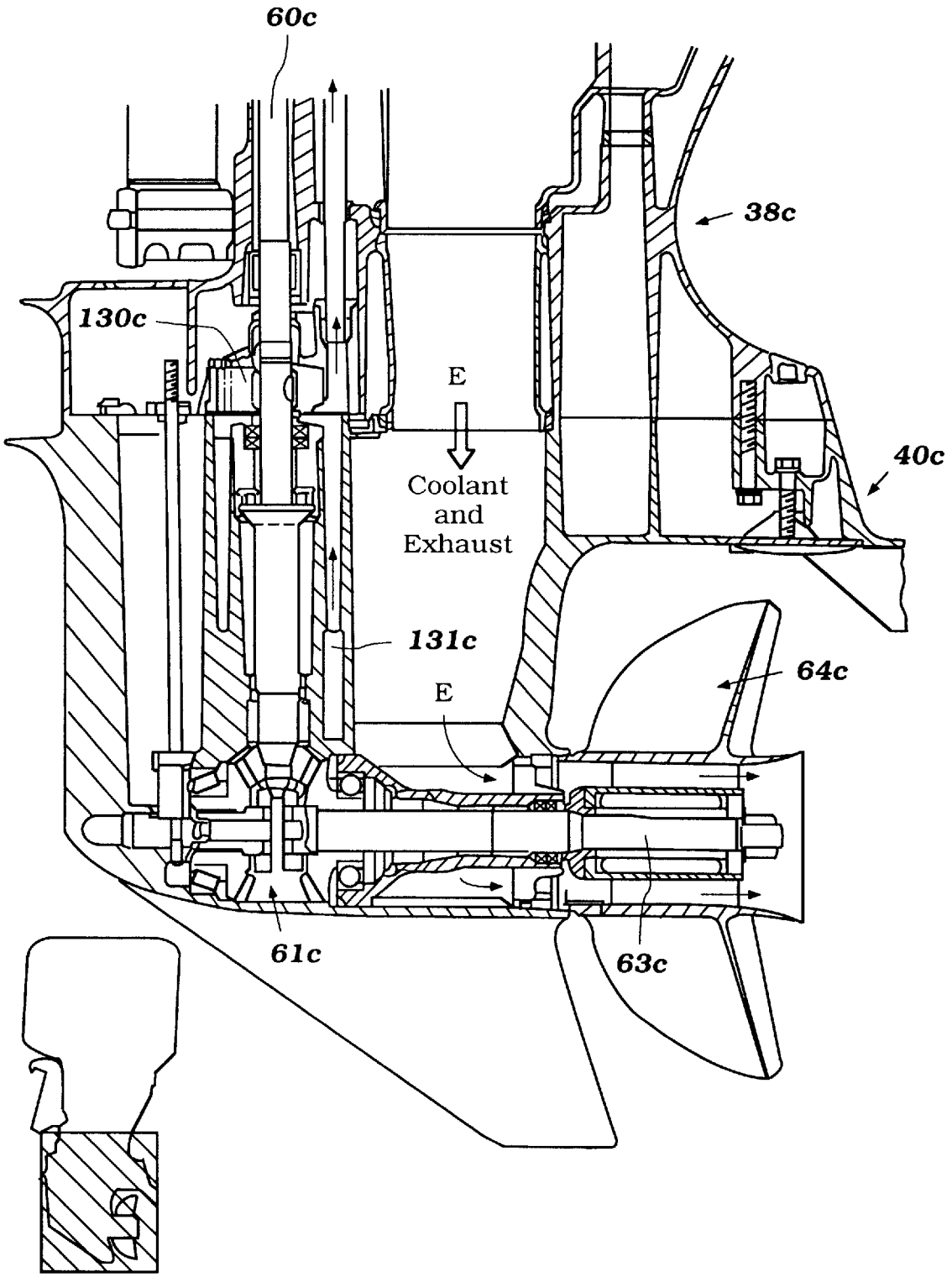
FIG. 15 is an enlarged cross-sectional side view of a lower portion of the motor illustrated in FIG. 12.
Figure 16:
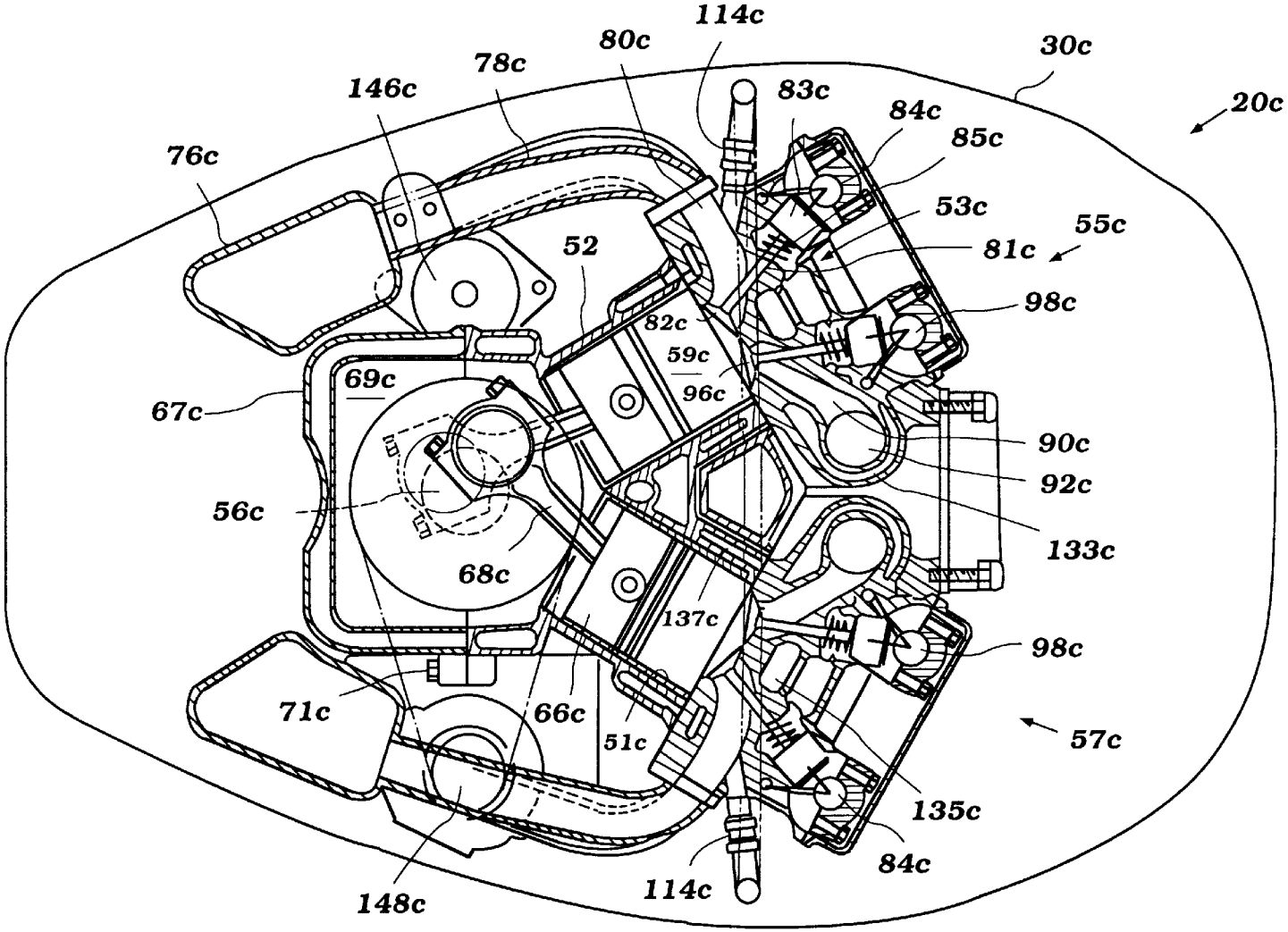
FIG. 16 is a cross-sectional top view of the motor illustrated in FIG. 12, taken along a plane passing through the engine therein.
Figure 17:
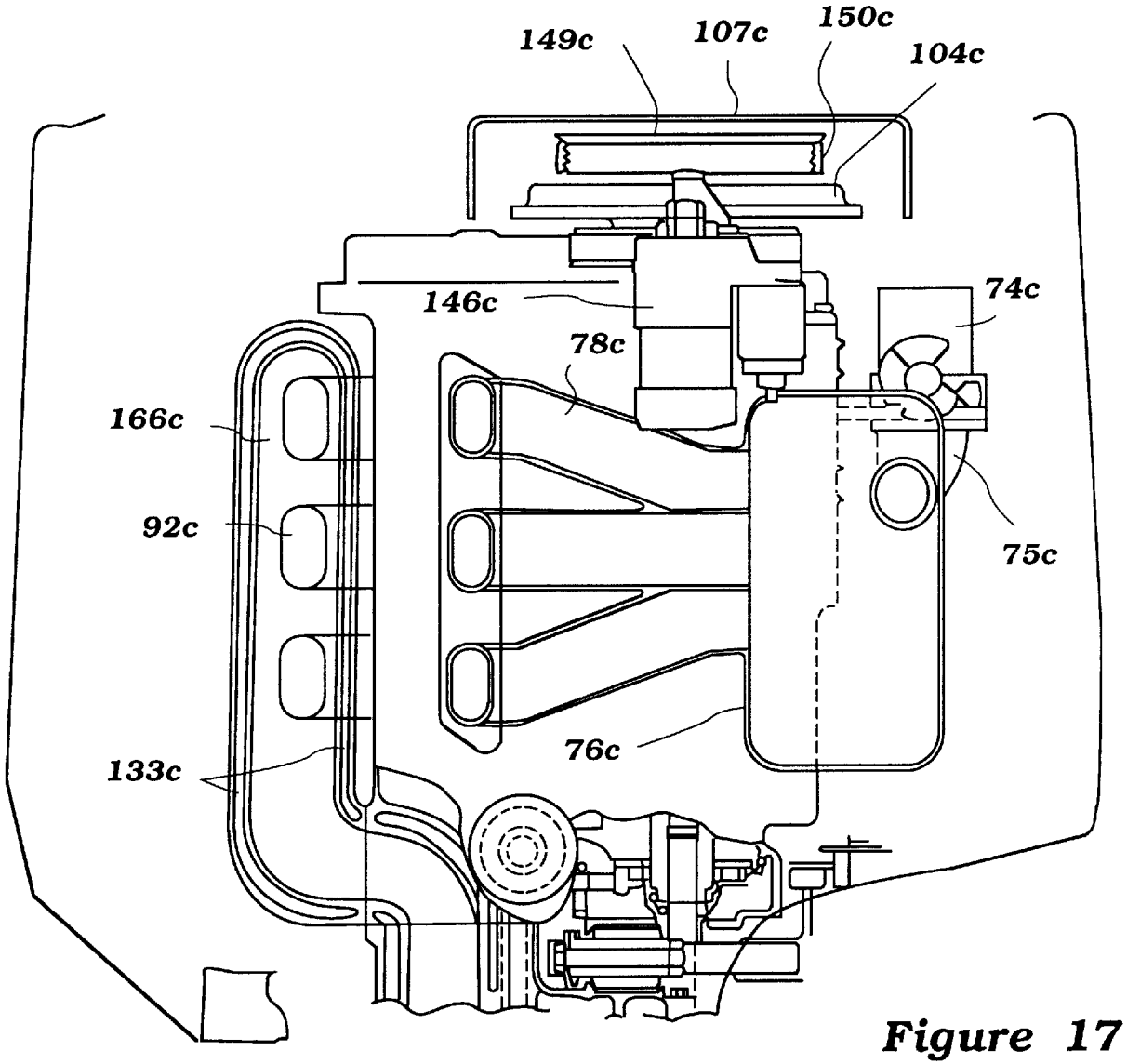
FIG. 17 is a cross-sectional side view of the motor illustrated in FIG. 12, exposing the engine therein.

The drive arrangement of this fourth embodiment is illustrated in FIGS. 12, 13 and 17. In this embodiment, the camshaft drive is positioned at the top end of the engine 22*c*. Here, a sprocket 168*c* is positioned on the crankshaft 56*c* just below the flywheel 104*c* near a top end of the crankshaft 56*c*. The timing chain 170*c* extends from the gear 168*c* to drive one or more of the camshafts 84*c,*98*c* in a manner similar to those of the embodiments described above. Preferably, the timing chain 170*c* is mounted within a space defined under a timing chain cover 109*c*.

In addition, in this drive arrangement, the pulley 149*c* which is used to drive the generator 148*c* is positioned above the flywheel 104*c* on the top end of the crankshaft 56*c*.

The drive arrangement of this embodiment is advantageous since the crankshaft 56*c* need not extend far beyond the end of the engine 22*c* to accommodate the flywheel 104*c* (since, as compared to the embodiment illustrated in FIG. 1, the crankshaft 56*c* need not extend far beyond the engine to accommodate the pulley 149*c* and then the flywheel 104*c*). Thus, the heavy flywheel 104*c* (which typically vibrates) is kept closer to the middle of the crankshaft 56*c,* reducing the fatigue on the crankshaft 56*c* and extending its life.

Of course, the foregoing description is that of preferred embodiments of the invention, and various changes and modifications may be made without departing from the spirit and scope of the invention, as defined by the appended claims.

What is claimed is:

1. An outboard motor comprising a cowling, an engine positioned within the cowling, and a water propulsion device, said engine having a body defining at least one combustion chamber, an intake passage leading to said chamber and an exhaust passage leading from said chamber, said engine including a crankshaft driven by a member movably mounted in said combustion chamber, said engine oriented such that said crankshaft is generally vertically extending, said engine having a top end and a bottom end, said crankshaft arranged in driving relationship with said water propulsion device, first valve means for selectively opening and closing at least a part of said intake passage and second valve means for selectively opening and closing at least a part of said exhaust passage, at least one camshaft for actuating said first and second valve means, a flexible transmitter positioned at said bottom end of said engine and driven by said crankshaft and directly driving at least one camshaft.

2. The outboard motor in accordance with claim 1, including an exhaust guide positioned below said engine, said flexible transmitter positioned adjacent said exhaust guide.

3. The outboard motor in accordance with claim 1, wherein said engine is of the "V" type having a first bank with at least one combustion chamber and a second bank with at least one combustion chamber and at least one camshaft corresponding to each bank, said flexible transmitter directly driving at least one camshaft corresponding to each bank.

4. The outboard motor in accordance with claim 3, wherein an intake camshaft and an exhaust camshaft are provided corresponding to each bank, said flexible transmitter directly driving an intake camshaft of one a first bank and including first timing drive means for driving an exhaust camshaft of said first bank from said intake camshaft, said flexible transmitter directly driving an exhaust camshaft of the second bank, and further including second timing drive means for driving an intake camshaft of said second bank from said exhaust camshaft.

5. The outboard motor in accordance with claim 4, wherein said first timing drive means comprises a gear positioned on said intake camshaft in mating engagement with a gear positioned on said exhaust camshaft.

6. The outboard motor in accordance with claim 4, wherein said second timing drive means comprises a gear positioned on said exhaust shaft in mating engagement with a gear positioned on said exhaust shaft.

7. The outboard motor in accordance with claim 4, wherein said first timing drive means comprises a flexible transmitter.

8. The outboard motor in accordance with claim 4, wherein said second timing drive means comprises a flexible transmitter.

9. The outboard motor in accordance with claim 4, wherein said flexible transmitter comprises a chain, said chain engaging a first sprocket positioned on said crankshaft, a second sprocket positioned on said intake camshaft, and a third sprocket positioned on said exhaust camshaft.

10. The outboard motor in accordance with claim 1, wherein said engine is of the "V" type having a first bank and a second bank, each bank having an exhaust camshaft mounted near a valley of said engine and an intake camshaft positioned opposite said valley, and said flexible transmitter drives at least one of said camshafts of each bank.

11. The outboard motor in accordance with claim 10, wherein said flexible transmitter directly drives an intake camshaft of said first bank and an exhaust camshaft of said second bank.

12. The outboard motor in accordance with claim 10, wherein said flexible transmitter directly drives an exhaust camshaft of said first and second bank.

13. An outboard motor comprising a cowling, an engine positioned within the cowling, and a water propulsion device, said engine having a first bank defining at least one combustion chamber and a second bank defining at least one combustion chamber, an intake passage leading to said chamber and an exhaust passage leading from said chamber, said engine including a crankshaft driven by a member movably mounted in said combustion chamber, said engine oriented such that said crankshaft is generally vertically extending, said engine having a top end and a bottom end, said crankshaft arranged in driving relationship with said water propulsion device, first valve means for selectively opening and closing at least a part of said intake passage and second valve means for selectively opening and closing at least a part of said exhaust passage, an intake and an exhaust camshaft corresponding to said first bank for actuating said first and second valve means, respectively, and an intake and exhaust camshaft corresponding to said second bank for actuating said first and second valve means, respectively, and a flexible transmitter driven by said crankshaft and directly driving both exhaust camshafts.

14. The outboard motor in accordance with claim 13, wherein said crankshaft has a top end, a flywheel positioned on said top end of said crankshaft, and said flexible transmitter is driven by said crankshaft below said flywheel.

15. The outboard motor in accordance with claim 14, wherein a pulley is positioned above said flywheel, and drive means extend from said pulley to an engine accessory for driving said accessory.

16. The outboard motor in accordance with claim 14, further including timing drive means for driving said intake camshaft of each bank by said exhaust camshaft of that bank.

17. An outboard motor comprising a cowling, an engine positioned within the cowling, and a water propulsion device, said engine having a first bank defining at least one combustion chamber and a second bank defining at least one combustion chamber, an intake passage leading to said chamber and an exhaust passage leading from said chamber, said engine including a crankshaft driven by a member movably mounted in said combustion chamber, said engine oriented such that said crankshaft is generally vertically extending, said engine having a top end and a bottom end, said crankshaft arranged in driving relationship with said water propulsion device, first valve means for selectively opening and closing at least a part of said intake passage and second valve means for selectively opening and closing at least a part of said exhaust passage, an intake and an exhaust camshaft corresponding to said first bank for actuating said first and second valve means, respectively, and an intake and exhaust camshaft corresponding to said second bank for actuating said first and second valve means, respectively, and a flexible transmitter driven by said crankshaft and directly driving an intake camshaft of said first bank and an exhaust camshaft of said second bank.

18. The outboard motor in accordance with claim 17, wherein said crankshaft has a top end, a flywheel positioned on said top end of said crankshaft, and said flexible transmitter is driven by said crankshaft below said flywheel.

19. The outboard motor in accordance with claim 18, wherein a pulley is positioned above said flywheel, and drive means extend from said pulley to an engine accessory for driving said accessory.

20. The outboard motor in accordance with claim 18, further including timing drive means for driving said intake camshaft of each bank by said exhaust camshaft of that bank.

* * * * *